United States Patent [19]

Chang

[11] Patent Number: 4,752,051

[45] Date of Patent: Jun. 21, 1988

[54] SOUND DEVICE ATTACHED TO KITE STRING

[76] Inventor: Wen-Ping Chang, 5th Fl, 187, Min Chyuan Rd., Taichung, Taiwan

[21] Appl. No.: 899,301

[22] Filed: Aug. 21, 1986

[51] Int. Cl.[4] ..... B64C 31/06

[52] U.S. Cl. ..... 244/155 R; 446/265; 446/397

[58] Field of Search ..... 244/153 R, 153 A, 154, 244/155 R, 155 A; 446/34, 236, 255, 265, 397

[56] References Cited

U.S. PATENT DOCUMENTS

| | | | |
|---|---|---|---|
| 1,914,822 | 6/1933 | Bryan | 244/153 R |
| 2,240,881 | 5/1941 | Bradford | 244/154 |
| 2,800,293 | 7/1957 | Kindelberger | 244/155 R |
| 2,940,755 | 6/1960 | Pouder | 446/397 |
| 4,129,274 | 12/1978 | Baker | 244/155 R |

*Primary Examiner*—Galen Barefoot

*Attorney, Agent, or Firm*—Browdy and Neimark

[57] ABSTRACT

A device which can be tied onto the string of the kite of any kind for producing sound. The windsail of the device rotates to produce a sound imitating the frog's crow.

4 Claims, 2 Drawing Sheets

SOUND DEVICE ATTACHED TO KITE STRING

BACKGROUND OF THE INVENTION

Chinese kites of the older times made sounds. Many people are interested in kites that make sound. The reason why it is not commonly used are the construction technique and the restrications, of the shape and size of the kite and the strength of the wind. In order to satisfy this need, a device which is tied to the string of a kite is designed to produce sound no matter what the shape, size of the kite are and how strong the wind would be. That gives more liveliness and variation of flying kite activities.

SUMMARY OF THE INVENTION (1) The sound making device is tied to the string of the kite and produces sound. This is a creative design and is considered to be the first of its kind in the world.

(2) This device can be attached to any type of kite. Under second class of wind, the windsail rotates and produces sound. It is practical.

(3) When the windsail rotates it is "pretty" lively. It is artistic.

(4) The design can be produced massively with machinery. The parts can be taken apart for packing. It is economical.

DETAILED DESCRIPTION OF THE PREFERRED EMBODIMENT

Figure 1:
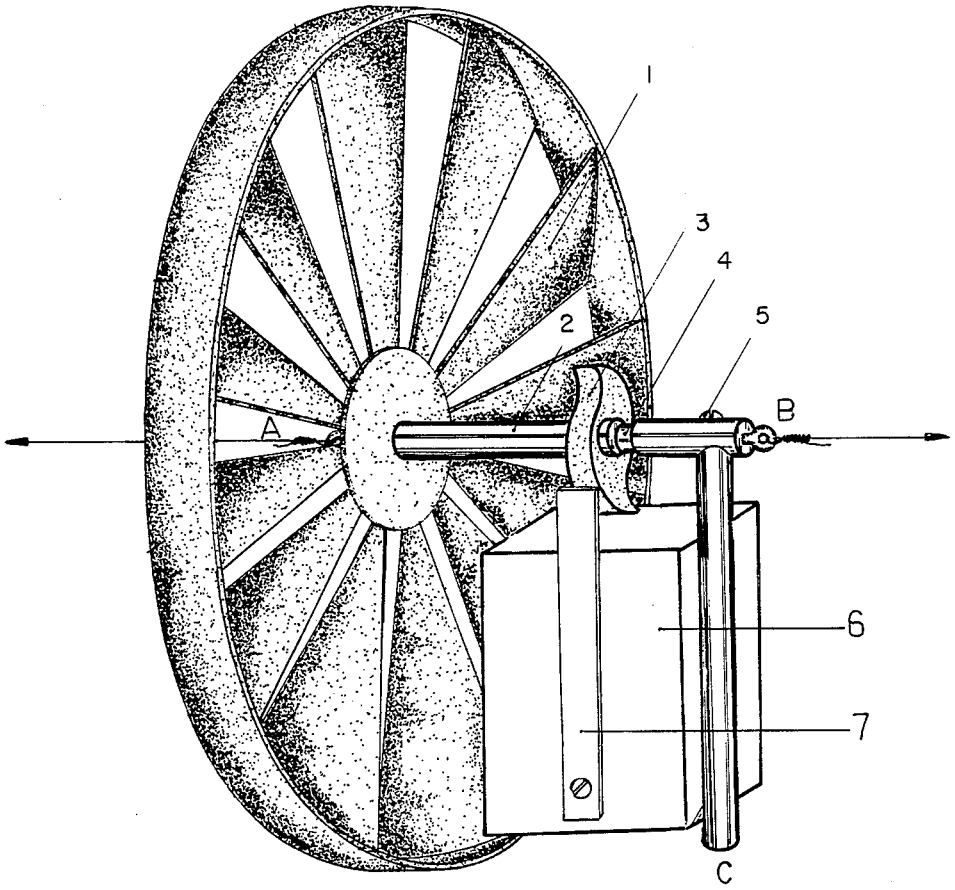
FIG. 1. shows the device according to the present invention.
Figure 2:
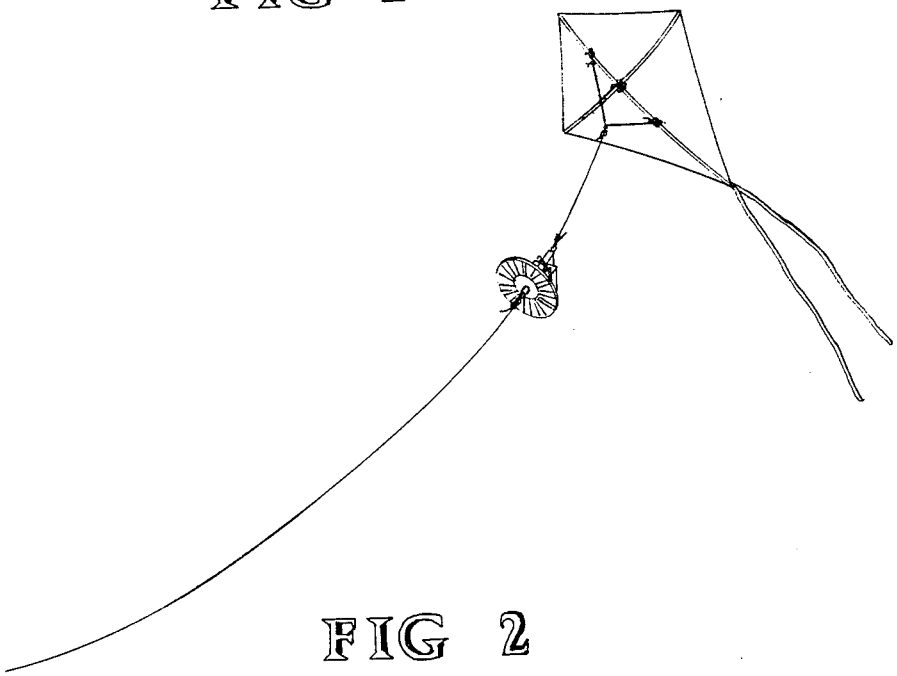
FIG. 2. shows the device in use on a kite.
Figure 4:
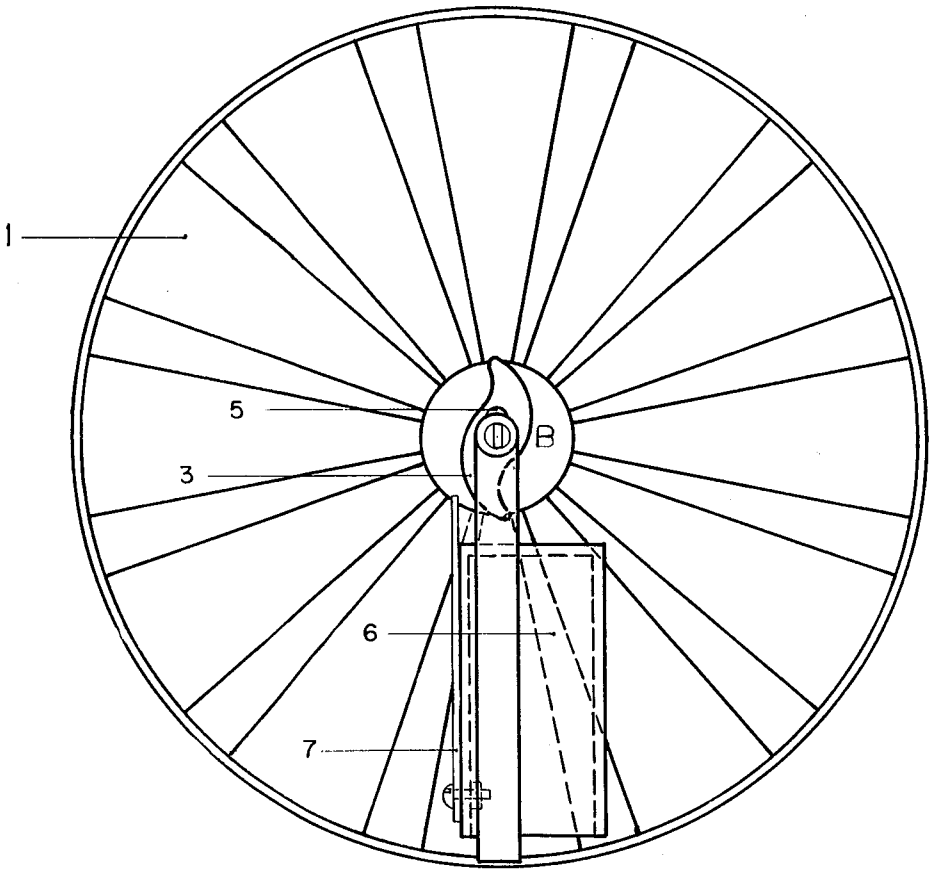
FIG. 4. shows a view of the device.
Figure 3:
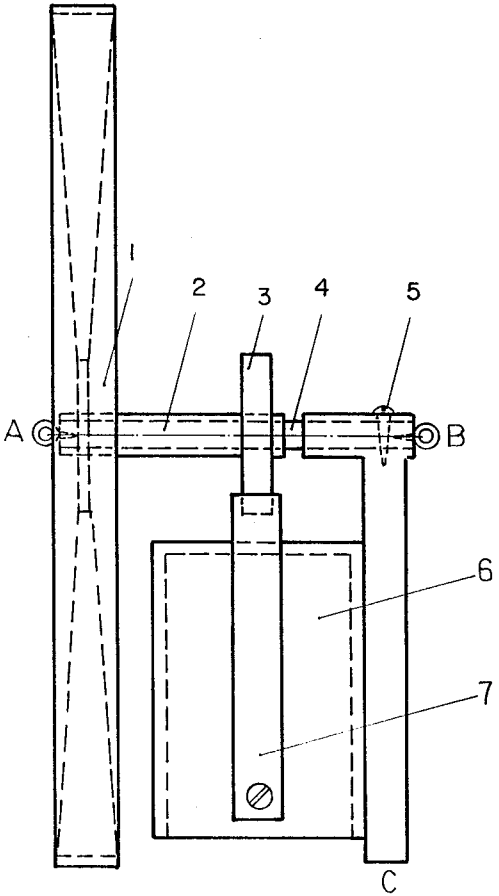
FIG. 3. shows a side view of the device.

1. Windsail
2. External axis of the coaxial axis
3. Internal axis of the coaxial axis
4. Pluching device 5. Screw
6. Resonance box
7. Spring The applied design has a simple structure and its assembly shown in the diagram. The windsail (labelled as 1) and external axis (labelled as 2) and the plucking wheel (labelled as 3) as a rigid part inserted to the internal axis. As the plucking wheel rotates the spring vibrates so that sound is produced from the resonant box. The device can be easily tied at A (shown in diagram) with the string about 1 to 2 meters from the kite. Since the device is light, it is airborne by the kite. The internal axis is fixed by the kite string. The windsail, the pluck and the external axis as a unit rotate with respect to the fixed internal axis. The rotation of the pluck causes the spring to hit on the resonant box to produce sound. The resonant box adjusts its position because of its weight. Its function is to stabilize the kite. The resonant box is small enough to be covered by the windsail and the opening of the resonant box is always directed downward so does the direction of the sound transmission.

I claim:

1. A kite which produces sounds when the kite is flown comprising:

a kite;

a string attached to said kite;

a device for producing sound attached to said string at a distance from said kite;

said device comprising:

a windsail having an internal axis and an external axis;

a rigid plucking wheel inserted in said internal axis;

a spring depending downwardly from said plucking wheel in a position to be caused to vibrate when said plucking wheel is rotated;

a resonant box attached to said spring.

2. The kite of claim 1 wherein said resonant box is covered by said windsail.

3. The kite of claim 2 wherein said device is separated from said kite by a distance of from 1 to 2 meters.

4. The kite of claim 3 wherein said resonant box is positioned so that an opening of said resonant box is directed downwardly when said kite is flown.

* * * * *